US005265590A

United States Patent [19]

Takagi

[11] Patent Number: 5,265,590

[45] Date of Patent: Nov. 30, 1993

[54] MOTOR-DRIVEN MASSAGER WITH VARIABLE SPEED CONTROL

[75] Inventor: Yasuyuki Takagi, Hikone, Japan

[73] Assignee: Matsushita Electric Works, Ltd., Osaka, Japan

[21] Appl. No.: 763,611

[22] Filed: Sep. 23, 1991

[30] Foreign Application Priority Data

Sep. 28, 1990 [JP] Japan ..... 2-262531

[51] Int. Cl.[5] ..... A61H 1/00

[52] U.S. Cl. ..... 128/33; 128/32; 128/44; 128/52

[58] Field of Search ..... 128/33, 32, 36, 46, 128/49, 52, 44, 51, 48; 318/138, 624

[56] References Cited

U.S. PATENT DOCUMENTS

| | | | |
|---|---|---|---|
| 3,696,278 | 10/1972 | Kuniyoshi et al. | 318/138 |
| 3,697,839 | 10/1972 | Unnewehr | 318/138 |
| 4,422,448 | 12/1983 | Sugai et al. | 128/60 X |
| 4,422,449 | 12/1983 | Hamabe | 128/60 X |
| 4,770,065 | 9/1988 | Woyton | 318/624 |
| 5,022,384 | 6/1991 | Freels et al. | 128/33 |

*Primary Examiner*—Robert A. Hafer
*Assistant Examiner*—Brian E. Hanlon
*Attorney, Agent, or Firm*—Stevens, Davis, Miller & Mosher

[57] ABSTRACT

A motor operated massager has a DC motor and an applicator driven thereby at a variable operation speed to apply a massaging action to a user's body during which the motor suffers a varying load in consequence of that the applicator means is pressed at a varying force against the user's body. A control is made to keep the operation speed at a selected level in accordance with a varying load requirement until the load reaches a tolerable load limit which is determined in correspondence to the selected operation speed. When the load increases beyond the tolerable limit, the motor is controlled differently to decrease the operation speed to such an extent as to follow the load increase until the load reaches a predetermined maximum load limit. Upon reaching the maximum load limit, the motor is stalled while limiting a motor current to a fixed level.

4 Claims, 4 Drawing Sheets

MOTOR-DRIVEN MASSAGER WITH VARIABLE SPEED CONTROL

BACKGROUND OF THE INVENTION

1. Field of the Invention

The present invention is directed to a motor-driven massager, and more particularly to a massager having an applicator driven by a motor at a variable operation speed to apply a massaging action to a user's body.

2. Background of the Invention

Prior massagers are known to include an electric motor for driving an applicator at a variable operation speed so that a user can select a suitable operation speed depending upon the portions of the body intended to be massaged. For example, Japanese Patent non-examined early publication (KOKAI) No. 61-247456 proposes a motor-operated massager which is capable of selecting an optimum operation speed depending upon a particular portion of the body intended to be massaged in order to achieve a comfortable massage action at the optimum operation speed. However, even when an optimum operation speed is selected, the operation speed will inevitably vary with a varying load requirement received by the motor due to ever changing pressing forces at which the applicator is pressed against the user's body. That is, the operation speed will normally decrease with the increase of the load requirement, thereby failing to continue the massaging action at the optimum operation speed selected for the intended portion. To avoid the above insufficiently, it is contemplated to control the operation speed kept constant at the selected speed irrespective of the varying load requirement. However, it is found that such scheme alone would result rather in ineffective massaging, particularly when a high operation speed is selected. That is, when the load is increased beyond a certain level, the continued massaging with the operation speed kept still at the high speed would give unpleasant and unnatural massaging effect to the user. Further, the above scheme poses another problem in that the motor is required to have a high power capability and therefore be bulky in order to afford the high speed operation even at the increased load requirement.

SUMMARY OF THE INVENTION

The above problems and insufficiencies have been eliminated in a motor-operated massager of the present invention. The massager in accordance with the present invention comprises an electric motor and an applicator driven by the motor at a variable operation speed. The applicator is adapted in use to be pressed against the user's body to apply a massaging action thereto during which the motor is expected to receive a varying load as a function of the pressing force of the applicator. A control circuit is included to control the motor through a first control stage and a second control stage as the load increases to a predetermined maximum limit. At the first control stage, a control is made to keep the operation speed at a selected level irrespective of the load variation within a predetermined tolerable limit of the load. As the load increases beyond the tolerable limit, the control goes to the second control stage for decreasing the operation speed with the load increase. When the load reaches the maximum limit, the motor is controlled to stall. The above control is reversible so as to resume the first and second control stages, respectively in response to the load decrease from the maximum limit and from the tolerable limit. Therefore, by suitably choosing the tolerable limit as a limit within which a comfortable massage is expected at the selected operation speed, it is possible to continue the massage with the constant operation speed as desired by the user for assuring a comfortable and effective massage, and to decrease the operation speed as the load increases beyond the comfortable limit for avoiding to keep the operation speed constant even at the more increased load and therefore preventing unpleasant combination of the operation speed and the increased load. Further, since the operation speed is caused to decrease as the load increases beyond the tolerable limit, the motor is not required to have an extra power as might be necessary if the operation speed be kept constant even when the load increases beyond the tolerable limit.

Accordingly, it is a primary object of the present invention to provide a motor-operated massager which is capable of assuring a comfortable and effective massaging action, yet requiring less power requirement to the motor.

The massager includes a speed selector for selecting the operation speed from a predetermined speed range. The tolerable load limit is set to vary depending upon the selected speed so when to be greater as the lower operation speed is selected. This is in conformity with a natural massage performance that a user expects. The constant operation speed typically massages up to a greater load at a lower operation speed that at a higher one.

It is therefore another object of the present invention to provide a motor-operated massager which realizes a consistent control for achieving natural and comfortable massaging action over the selectable operation speed range.

A DC motor is utilized as the motor which has a characteristic of increasing the load with the increase in a driving voltage at which the motor is energized. The control circuit comprises a speed controller, a voltage limiter, a current limiter, and lock sensor. The speed controller, which is responsible for keeping the operation speed at the selected speed during the first control stage, monitors the speed of the motor and controls to adjust the driving voltage based upon the monitored speed in order to keep the operation speed constant at the selected speed within the tolerable load. The voltage limiter monitors the driving voltage applied to the motor and operates to limit the driving voltage at a predetermined level as long as the load exceeds the tolerable limit, thereby allowing the operation speed to slow down as the load increases from the tolerable limit up to the maximum limit during the second control stage. The current limiter is provided to monitor a motor current being fed to drive the motor and control for keeping the motor current at a critical level defining the maximum load limit upon the motor current reaching the critical level indicative of that the load reaches the maximum limit. At this occurrence, the motor is kept generating a corresponding torque determined solely by the motor current irrespective of whether the motor rotates or stalls. The lock sensor is provided to acknowledge that the motor is locked when the monitored speed is decreased down to a minimum speed or zero to that the motor is caused to stop upon detection, and thus to be locked. Preferably, the lock sensor is configured to acknowledge the lock of the motor when the monitored speed is decreased down to the minimum speed and such condition lasts for a predetermined time period. Thus, the above consistent speed/load control up to the maximum load limit can be successfully achieved by the combination of the speed controller, the voltage limiter, the current limiter, and the lock sensor, which is therefore a further object of the present invention. The DC motor is preferably a brushless motor incorporating Hall-effect elements for sensing a rotor speed of the motor as representative of the operation speed.

Preferably, the control circuit includes a safety unit, in response to sensing the lock of the motor, operates to temporally reverse the motor before stopping it, thereby facilitating to eliminate a potential hazard in that the portion of the body is unexpectedly arrested by the applicator the motor locked. This is particularly advantageous for safety when the applicator is formed to have a pair of pads swinging to and fro in the direction of narrowing and expanding the distance therebetween as the motor rotates with a tendency to pinch the portion of the body between the applicator pads.

It is therefore a further object of the present invention to provide a motor-operated massager which incorporates a safety hazard protection so that the user can enjoy the desired massage safely.

These and other objects and advantageous features of the present invention will become more apparent from the following description of the preferred embodiment of the present invention when taken in conjunction with the attached drawings.

DETAILED DESCRIPTION OF THE PREFERRED EMBODIMENT

Figure 1:
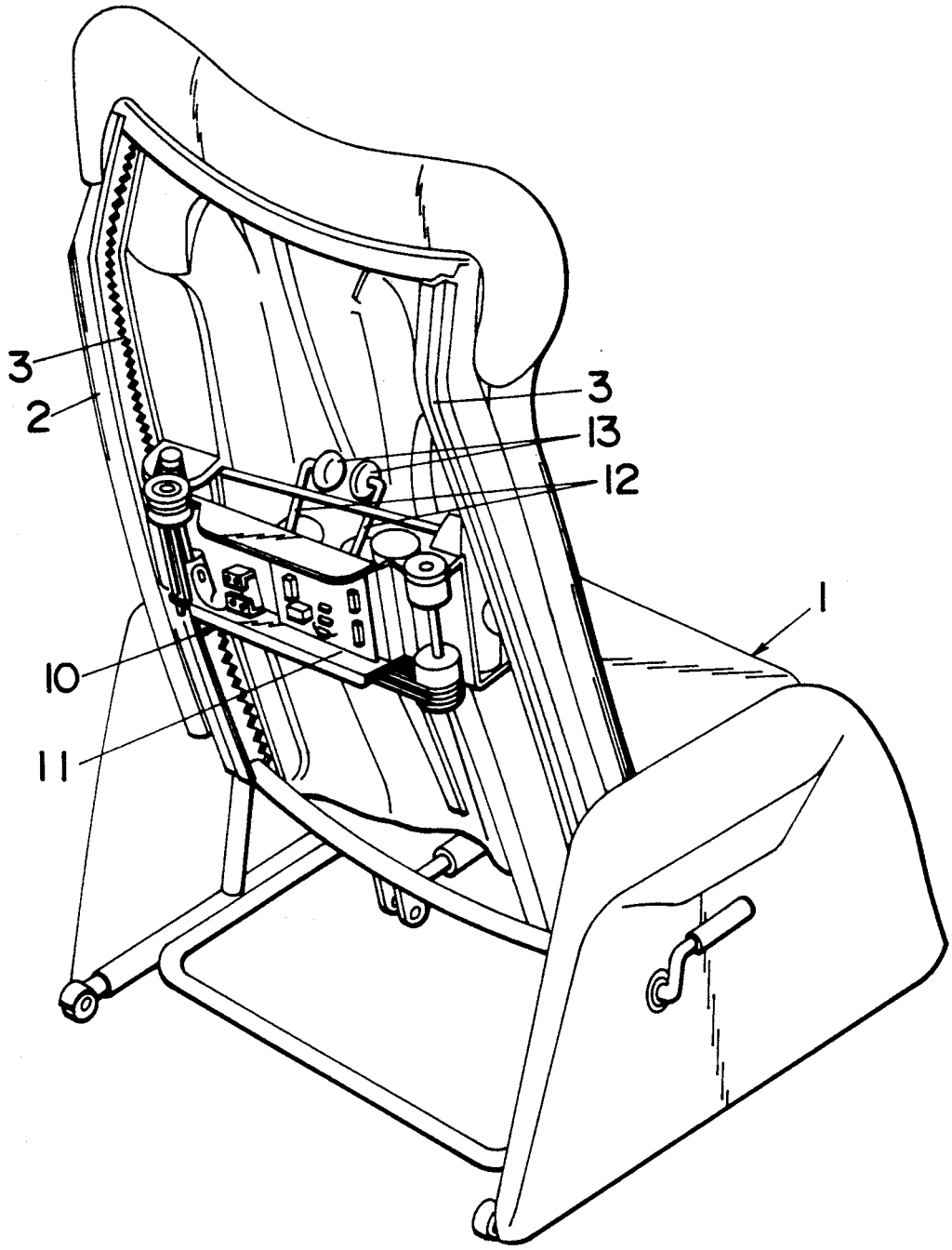
FIG. 1 is a perspective view of a motor-operated massager as presented in the form of a massaging chair in accordance with a preferred embodiment of the present invention.

Referring now to FIG. 1, there is shown a motor-operated massager presented as a chair-type massager in accordance with a preferred embodiment of the present invention. The massager includes a massaging unit 10 mounted in a reclining chair 1 to be movable along a chair's back 2. The massaging unit 10 includes a pair of applicator pads 13 which are driven to move in various directions to apply multiple massaging actions to the back of the user from the waist to the neck. To this end, the massaging unit 10 incorporates an electric motor (not seen in FIG. 1) which is, for example, a DC brushless motor connected through a transfer mechanism (also not seen) and a pair of arms 12 to swing the applicator pads 13 in various directions. The transfer mechanism includes a drive shaft (not shown) driven to rotate about its axis by the motor, a pair of axially spaced disks (not shown) carried by the drive shaft in eccentric and inclined relation thereto, and a corresponding pair of outer rings fitted respectively around the disks to be freely rotatable relative thereto. Each of the arms 12 is pivotally supported at its one end opposite of the applicator pad 13 to a unit frame 11 and is engaged with the outer ring at a portion intermediate the ends so that the applicator pad 13 is caused to move in various directions as the disks rotates about the axis of the drive shaft in an eccentric and inclined relation thereto. The disks are inclined in a symmetric fashion such that the applicator pads 13 can swing to and fro in a direction of narrowing and expanding the distance therebetween to give a kneading massaging action to the user's body. The detail mechanism of transferring the rotary motion of the motor to the swinging motion of the applicator pads 13 are known in Japanese Patent Publication (KOKOKU) No. 01-48771 published on Oct. 20, 1989 which is incorporated herein in its entirety by reference. The massaging unit 10 is held between a pair of racks 3 and is driven to move up and down by the common motor or a separate motor.

Figure 2:
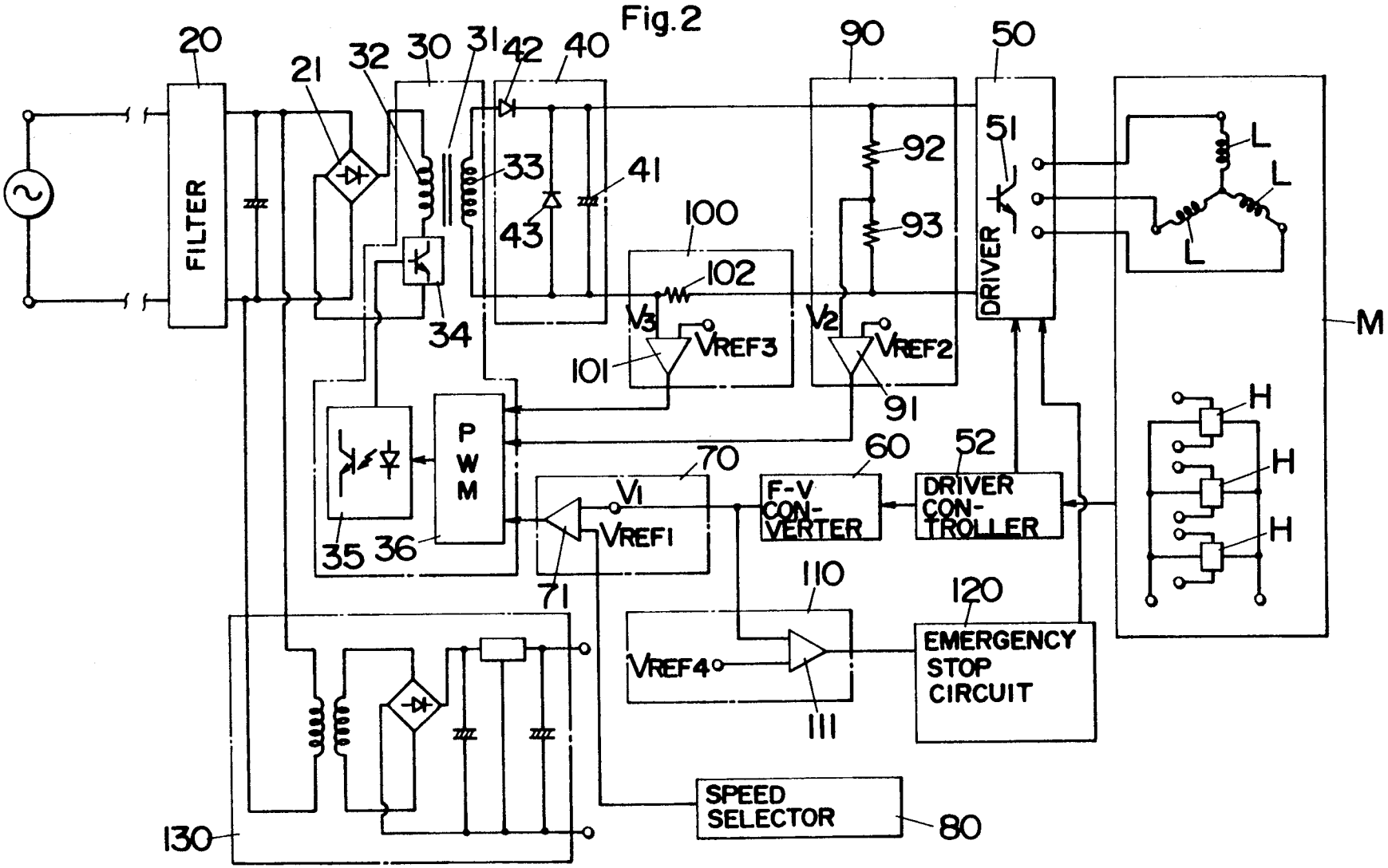
FIG. 2 is a circuit diagram illustrating a control circuit of the massager.

The massager includes a control circuit to drive the motor and therefore the applicator pads 13 at varying Operation speed or output torque in a controlled manner. As shown in FIG. 2, the control circuit comprises a full-wave rectifier 21 connected through a filter 20 to an AC power source to provide a rectified DC voltage to an inverter 30. The inverter 30 includes a transformer 31, a switching transistor 34 connected in series with a primary winding 32 of the transformer 31. The switching transistor 34 is turned on and off at a frequency of about 100 kHz to develop across a secondary winding 33 a corresponding AC voltage which is then smoothed and rectified at a AC-to-DC converter 40 composed of capacitor 41 and diodes 42 and 43 to provide a smoothed DC voltage which is applied through a driver 50 to the DC motor M. That is, the DC voltage is fed through a driver 50 to flow a motor current through coils L of the DC motor M for driving the motor M. The switching transistor 34 is coupled through a photocoupler 3$ to a pulse-width-modulator (PWM) 36 so as to be controlled thereby to vary the resulting output AC voltage of the inverter 30 and therefore the driving DC voltage applied to the motor M in accordance with external control signals fed to the PWM 36. That is, the PWM 36 operates to increment and decrement the duty cycle of a pulse signal driving the switching transistor 34 in response to the external control signals so that the inverter 30 generates the varying output AC voltage, which in turn converted to give the correspondingly varying DC voltage applied to the motor M.

The motor M includes Hall-effect elements H which sense a rotor speed of the motor as representative of the operation speed of the massager and provides a corresponding output to a driver controller 52. The driver controller 52 responds to the output for giving to the driver 50 a drive signal designating which one of the coils L is to be energized. In this connection, the driver 50 includes transistor switches 51 for selective energization of the coils L. The driver controller 52 is also coupled to a frequency-voltage (F-V) converter 60 in which the sensed rotor speed is converted into a corresponding voltage signal $V_1$ indicative of the rotor speed or the operation speed. The voltage signal $V_1$ is fed to a speed controller 70 comprising a comparator 71 where it is compared with a reference voltage $V_{REF1}$ indicative of a selected operation speed to give the control signal to the PWM 36. The reference voltage $V_{REF1}$ is generated at a speed selector 80 to be in proportion to the operation speed selected by the user within a predetermined speed range. When the voltage signal $V_1$ is detected to be less than the reference voltage $V_{REF1}$, the comparator 71 outputs the control signal to the PWM 36 which responds to increment the duty cycle of the pulse for the switching transistor 34 to thereby increase the driving DC voltage to the motor M and therefore raise the motor speed, or the operation speed. When, on the other hand, the voltage signal $V_1$ is greater than reference voltage $V_{REF1}$, the comparator 71 issues the control signal such that the PWM 36 responds to decrement the duty cycle to thereby decrease the driving DC voltage and therefore lower the motor speed, or the operation speed. Thus, the comparator 71 acts in cooperation with the PWM 36 to control the operation speed in a feedback manner based upon the monitored rotor speed so as to keep the operation speed at the selected speed defined by $V_{REF1}$. Such speed control is, however, made available within a limited range of a load received at the motor M, or the output torque thereof, as will be explained hereinafter.

The control circuit also includes a voltage limiter 90 comprising voltage dividing resistors 92 and 93 connected in series across the output of the AC-to-DC converter 40 to provide a voltage signal $V_2$ which is a fraction of the driving DC voltage applied to the motor M and therefore indicative thereof. The voltage signal $V_2$ is fed to a comparator 91 where it is compared with a fixed reference voltage $V_{REF2}$ which corresponds to a maximum voltage limit allowed to the motor M and determines a tolerable load or torque limit within which the motor M is permitted to rotate constantly at the selected operation speed. With the use of the fixed reference voltage $V_{REF2}$, the tolerable torque limit can be set to vary in an inverse proportion to the operation speed. As will be discussed later with reference to FIG. 4, the tolerable torque or load limit $T_1$, $T_2$, . . . is made to increase with lowering of the selected operation speed over a high operation speed zone from $S_{MID}$ to $S_{MAX}$, within a selectable operation speed range from $S_{MIN}$ to $S_{MAX}$, thereby varying the tolerable load or torque limit $T_1$ to $T_{MAX}$ in association with the high speed zone $S_{MAX}$ to $S_{MID}$. Alternately, such tolerable torque limit may be set to vary over the full operation speed range $S_{MAX}$ to $S_{MIN}$.

When the voltage signal $V_2$ is detected to be greater than the fixed reference voltage $V_{REF2}$, the comparator 91 issues a voltage limit signal to the PWM 36 which responds to decrement the duty cycle of the pulse for the switching transistor 34 to thereby lower the output of the inverter 30 and therefore lower the motor driving DC voltage. Otherwise, the comparator 91 issues a control signal which does not require the PWM 36 to decrement the duty cycle or lower the motor driving DC voltage. Thus, the voltage limiter 90 operates to limit the increase of the motor driving DC voltage up to the fixed voltage limit $V_{REF2}$.

A current limiter 100 is included in the circuit to comprise a comparator 101 and a current sensor 102 sensing a motor current being fed to the motor M and providing a corresponding voltage signal $V_3$ to the comparator 101. The voltage signal $V_3$ is compared With a fixed reference voltage $V_{REF3}$ which corresponds to a maximum motor current permitted to be fed to the motor and therefore a maximum torque or load limit $T_{MAX}$ that the motor M can afford. When the motor current is sensed to be greater than the maximum motor current, i.e., $V_3 > V_{REF3}$, the comparator 101 generates a current limit signal requesting the PWM 36 to decrement the duty cycle in the direction of lowering the driving DC voltage, or decreasing the motor current. Otherwise, the comparator 101 generates a no-op signal requesting the PWM 36 not to vary the duty cycle.

Further, the control circuit includes a safety unit 110 comprising a comparator 111 at which the voltage signal $V_1$ indicative of the motor speed is compared with a fixed reference voltage $V_{REF4}$ corresponding to one half of the minimum operation speed $S_{MIN}$ or less. When the voltage signal $V_1$ is found to be less than the reference voltage $V_{REF4}$ as a result of that the operation speed is lowered down to one half of the minimum speed or less the comparator 111 issues a lock-probable signal to an emergency stop circuit 120. The emergency stop circuit 120 includes a counter which starts counting upon receiving the lock-probable signal so as to measure a time period T in which the lock-probable signal lasts ($V_1 > V_{REF4}$). When the time period exceeds a critical value, for example, 10 seconds ($T > 10$ sec), the emergency stop circuit 120 acknowledges that the motor M is locked and issues an emergency stop signal requesting to the driver 50 to reverse the motor M for 2 or 3 revolutions and stop the motor immediately thereafter.

An auxiliary power circuit 130 is provided to generate from the common AC power source a stabilized voltage source to be supplied to the individual circuits including PWM 36, driver 50, F-V converter 60, speed controller 70, speed selector 80, voltage limiter 90, current limiter 100, safety unit 110, and emergency stop circuit 120.

It is noted at this time that the PWM 36 is so configured as to be active in response to the signal in descending order of priority from the current limiter 100, voltage limiter 90, and speed controller 70. For example, the voltage limiter 90 is available only while the current limiter 70 does not cause the PWM 36 to decrement the duty cycle, and the speed controller 70 is available only while the voltage limiter 90 does not cause the PWM 36 to decrement the duty cycle, as will be apparent from the following discussion as to the operation of the control circuit.

Figure 3:
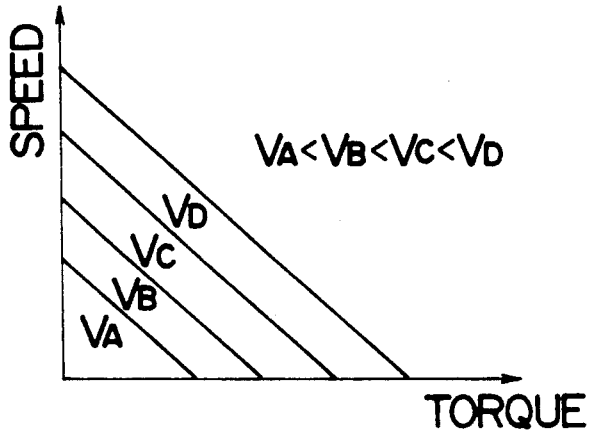
FIG. 3 is a chart illustrating typical speed-torque characteristics for a DC motor utilized in the massager.
Figure 4:
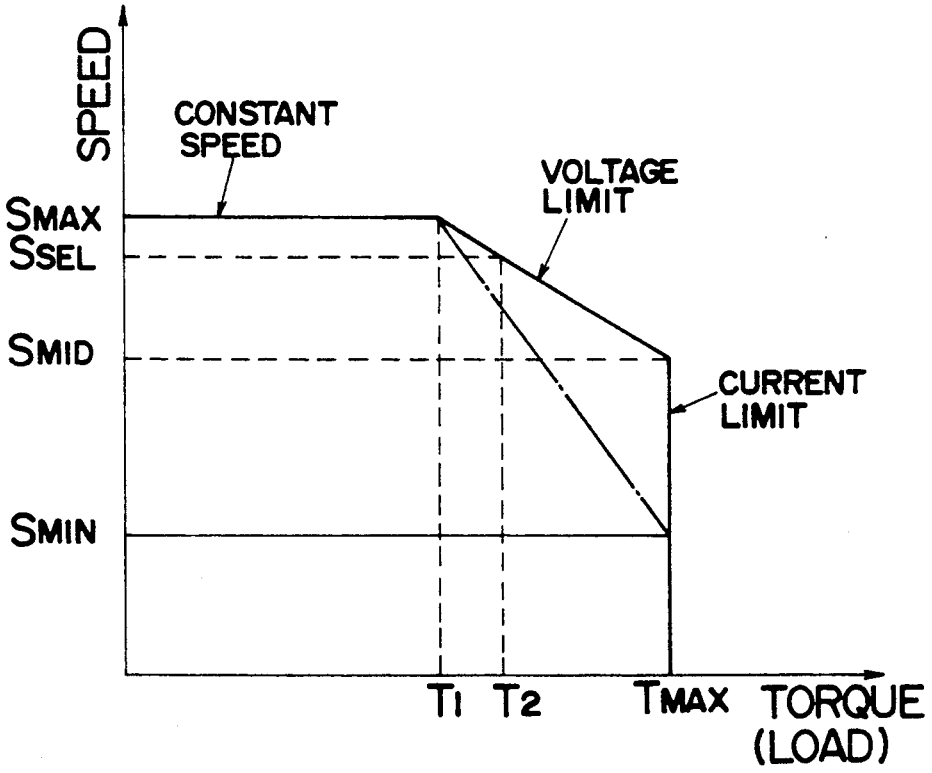
FIG. 4 is a chart illustrating the controlled operation of the motor speed in relation to a varying load applied to the motor.
Figure 5:
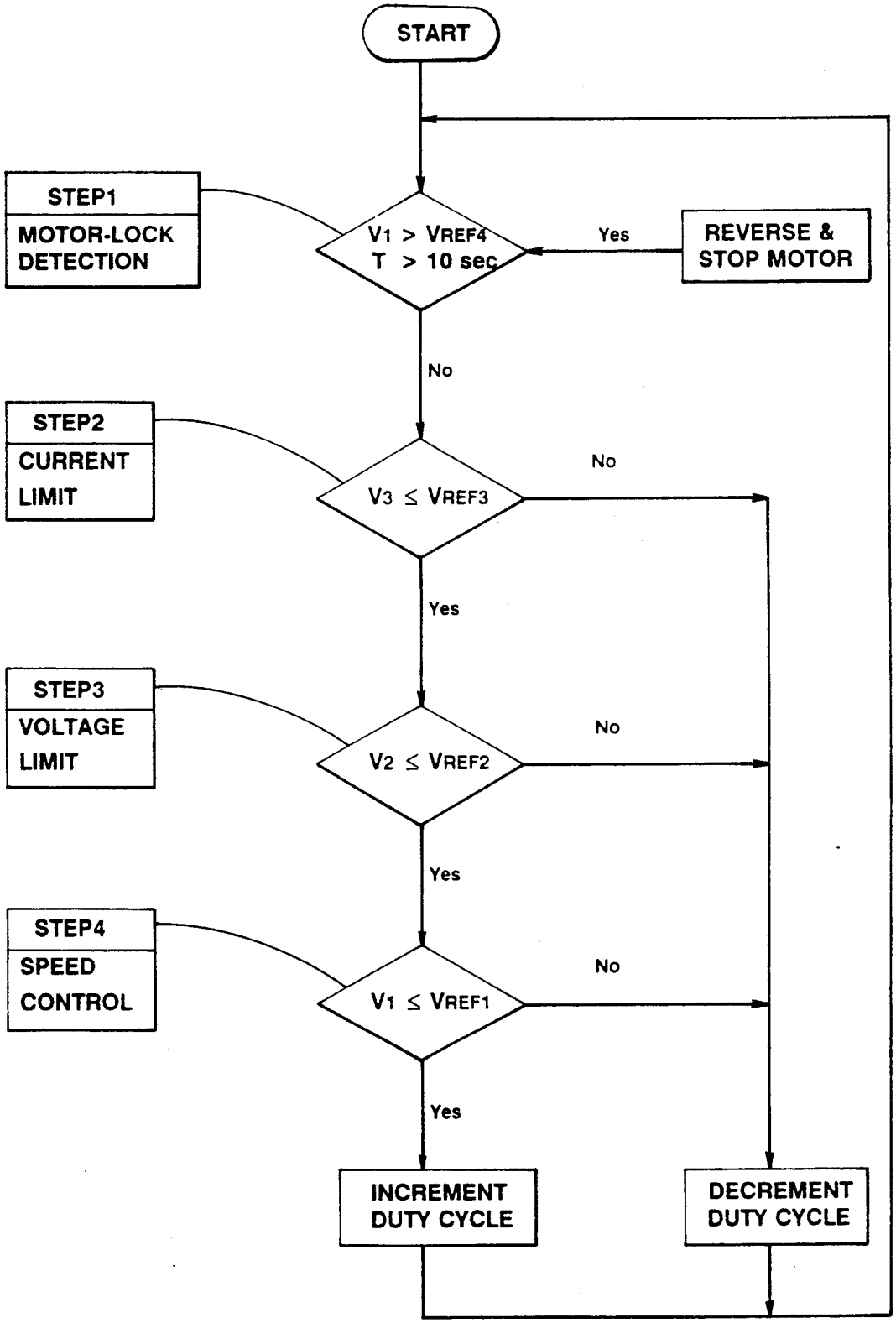
FIG. 5 is a flow chart illustrating the operation of the control circuit.

Prior to discussing the operation of the control circuit, it is pointed out that, as shown in FIG. 3, the DC motor exhibits typical speed-torque characteristics of increasing the output torque or load with the increase in the driving DC voltages from $V_A$ to $V_D$ while keeping the constant speed and of decreasing the speed with the increase in the output torque or load at the constant driving DC voltage. Now, the operation will be discussed in detail with particular reference to FIGS. 4 and 5. When the massager is started with the operation speed selected to be within the high speed zone $S_{MID}$ to $S_{MAX}$, the motor M is controlled to keep actuating the applicator at the selected operation speed irrespective of the load variation up to the tolerable load limit. For example, when the maximum speed $S_{MAX}$ is selected, the operation speed is kept constant until the load is increased to the corresponding tolerable limit $T_1$, and when an intermediate operation speed $S_{SEL}$ is selected, the operation speed is kept constant until the load is increased to the corresponding tolerable limit $T_2$, as shown in FIG. 4. When, on the other hand, the operation speed is selected to be within a lower speed zone $S_{MIN}$ to $S_{MID}$, the operation speed is kept constant until the load is increased to the maximum limit $T_{MAX}$.

During this first control stage of keeping the operation speed constant, the PWM 36 acts in response to the monitored motor speed to vary the driving DC voltage in conformity with the load variation. For example, as the load increases due to the increasing pressing force at which the applicator is pressed against the user's body with an attendant lowering of the operation speed, the PWM 36 responds immediately to such lowering motor speed [$V_1 < V_{REF1}$] for increasing the driving DC voltage in order to maintain the operation speed constant while allowing the output torque to increase in match with the load increase. It is noted at this time that during the first control stage the motor current is kept less than the maximum motor current ($V_3 \leqq V_{REF3}$) and the emergency stop signal is not issued from the emergency stop circuit 120 such that the PWM 36 can be kept responsive only to the speed controller 70 and the voltage limiter 90, as indicated by steps 4 and 3 in the flow chart of FIG. 5.

The above voltage increase is enabled until $V_2$ exceeds $V_{REF2}$, i.e., the load is increased to the tolerable limit, for example, $T_1$ or $T_2$. Upon this occurrence, the voltage limiter 90 comes into operation in preference to the speed controller 70 in order to prevent a further voltage increase by decrementing the duty cycle as soon as $V_2$ exceeds $V_{REF2}$, as indicated by step 3 of FIG. 5, thereby limiting the driving DC voltage at the fixed level after the load exceeds the tolerable limit. In this second control stage of limiting the driving DC voltage at the fixed level, the operation speed is allowed to vary with the load variation along an inclined line of FIG. 4. That is, as the load increases further the operation speed decreases and vice versa within the torque range from the tolerable limit to the maximum limit $T_{MAX}$. When the load decrease below the tolerable limit, the speed controller 70 again comes into operation. It is noted at this time that the above fixed level at which the driving voltage is limited in the second control stage may be selected to correspond to a maximum power that the motor can afford.

When the load reaches the maximum limit $T_{MAX}$, which is acknowledged by that the motor current is correspondingly increased to such an extent that $V_3$ exceeds $V_{REF3}$, the current limiter 100 takes over to limit the motor current at the fixed level corresponding to $V_{REF3}$ by decrementing the duty cycle to lower the driving DC voltage as soon as $V_3$ exceeds $V_{REF3}$, as indicated by step 2 of FIG. 4. Whereby the output torque is kept at the maximum load limit $T_{MAX}$ so long as the maximum load is received, thereby the motor M is allowed to stall or rotate very slowly at that torque. Therefore, when the load is decreased from the maximum load limit $T_{MAX}$, the second control stage resumes to keep the driving voltage at the limited level by the operation of the voltage limiter 90. On the other hand, when the load equal to or even greater than the maximum load limit $T_{MAX}$ is continuously received over the predetermined time period, i.e., 10 seconds, the emergency stop circuit 120 operates in cooperation with the safety unit 110 to acknowledge that the motor M is inadvertently locked and stop the motor M after reversing it for few revolutions. Whereby it is possible to give a chance to alleviate a potential hazard that, for example, the portion of the body is arrested or pinched between the applicator pads 13.

When the operation speed is selected to be within a lower speed zone $S_{MIN}$ to $S_{MID}$, the like speed control is made until the load increases to the maximum load limit $T_{MAX}$ without entering the second control stage of limiting the driving voltage, as shown in FIG. 4. However, it is equally possible to provide the second control stage over the full operation speed range from $S_{MIN}$ to $S_{MAX}$, as indicated by dotted inclined line of FIG. 4.

What is claimed is:

1. A motor-operated massager with speed control comprising:

an electric motor;

means for varying operational speed of said electrical motor;

massaging applicator means driven by said electric motor in conjunction with said speed varying means to apply a massaging action to a user's body, said electric motor receiving a varying load when said applicator means is pressed at varying levels of force against said user's body;

first control means for controlling said operational speed of said motor at a user selected level irrespective of a variation of said load within a predetermined user tolerable limit of said load;

second control means for decreasing operational speed of said motor when said levels of force increase beyond said user tolerable limit, said second control means stalling said electric motor when said load reaches said predetermined user tolerable limit;

massage speed selection means for selecting said operational speed from a predetermined speed range; and user tolerable limit determination means for determining said predetermined user tolerable limit in accordance with a selected operational speed and means for increasing the user tolerable as said selected operational speed is decreased.

2. A massager as set forth in claim 1, wherein said electric motor comprises a DC motor having means for increasing load with an increase in driving voltage and one of said first and second control means comprises:

speed control means for monitoring the speed of said motor and for adjusting the driving voltage based upon a monitored speed in order to maintain constant operation speed constant constant at said selected speed within said user tolerable limit;

voltage limiting means for monitoring the driving voltage applied to said motor and limiting said driving voltage at a predetermined level as long as said load exceeds said user tolerable limit to allow the operation a speed to slow down when said load increases from said user tolerable limit to a maximum limit;

current limiting means for monitoring a motor current supplied to drive said electric motor and limiting said motor current to a critical level to define said maximum limit of said load when said motor current reaches said critical level;

motor lock sensing means for detecting that said electric motor is locked when said monitored speed reaches a predetermined minimum speed and for stalling said motor when said predetermined minimum speed is reached; and safety means for temporarily reversing said motor and stopping said motor immediately thereafter when said motor lock sensing means detects that said electric motor is locked.

3. A massager as set forth in claim 2, wherein said DC motor comprises a brushless motor including means for converting a magnetic field to an electric field to sense a rotor speed of said DC motor as being representative of said operation speed.

4. A massager as set forth in claim 1, further comprising:

selecting means for selecting said operational speed from a predetermined speed range including a low speed zone and a high speed zone;

said first and second control means providing a low speed control mode or a high speed control mode when said operational speed is within said low speed zone or said high speed zone correspondingly, said low speed mode enabling said first control means until said load reaches a maximum load limit and limits a motor current to a critical level when said maximum load limit is reached, said high speed control mode enabling said first and second control means until said load reaches said maximum load limit; and limits the motor current to said critical level when said maximum load limit is reached.

* * * * *